US006547239B2

(12) United States Patent
Takata

(10) Patent No.: US 6,547,239 B2
(45) Date of Patent: Apr. 15, 2003

(54) ROLLER STRUCTURE FOR SHEET FEEDING APPARATUS

(75) Inventor: Kenji Takata, Kanagawa-ken (JP)

(73) Assignee: Fuji Photo Film Co., Ltd., Kanagawa-ken (JP)

( * ) Notice: Subject to any disclaimer, the term of this patent is extended or adjusted under 35 U.S.C. 154(b) by 90 days.

(21) Appl. No.: 09/814,945

(22) Filed: Mar. 23, 2001

(65) Prior Publication Data

US 2001/0028146 A1 Oct. 11, 2001

(30) Foreign Application Priority Data

Mar. 23, 2000 (JP) ..... 2000-082885

(51) Int. Cl.[7] ..... B65H 5/02; B65H 5/06
(52) U.S. Cl. ..... 271/274; 271/272; 271/273
(58) Field of Search ..... 271/274, 273, 271/272

(56) References Cited

U.S. PATENT DOCUMENTS 6,267,373 B1 * 7/2001 Takata ..... 271/274

FOREIGN PATENT DOCUMENTS

JP 6-16316 * 6/1994

* cited by examiner

*Primary Examiner*—Donald P. Walsh
*Assistant Examiner*—Jonathan R Miller
(74) *Attorney, Agent, or Firm*—Sughrue Mion, PLLC

(57) ABSTRACT

A circulatory feed system has roller pairs for feeding a stimulable phosphor sheet in a substantially horizontal attitude. Each of the roller pairs comprises first and second coupled rollers interconnected by a shaft for rotation in unison with each other, and first and second separate rollers which are independent of each other. The first and second separate rollers are disposed below the first and second coupled rollers, i.e., in a region toward which the stimulable phosphor sheet is flexed.

8 Claims, 10 Drawing Sheets

ROLLER STRUCTURE FOR SHEET FEEDING APPARATUS

BACKGROUND OF THE INVENTION

1. Field of the Invention

The present invention relates to a sheet feeding apparatus for feeding a sheet such as a stimulable phosphor sheet or the like.

2. Description of the Related Art

A system is known for recording radiation image information of a subject such as a human body with a stimulable phosphor, and reproducing the recorded radiation image information on a photosensitive medium such as a photographic film, or displaying the recorded radiation image information on a display device such as a CRT or the like.

The stimulable phosphor is a phosphor which, when exposed to an applied radiation (X-rays, α-rays, γ-rays, electron beams, ultraviolet radiation, or the like), stores a part of the energy of the radiation, and, when subsequently exposed to applied exciting rays such as visible light, emits light in proportion to the stored energy of the radiation. Usually, a sheet provided with a layer of the stimulable phosphor is used as a stimulable phosphor sheet.

The above known system includes a radiation image information reading apparatus which comprises an imaging unit 25 for recording the radiation image information of a subject on a stimulable phosphor sheet, and a reading unit for photoelectrically reading the recorded radiation image information from the stimulable phosphor sheet by applying exciting light to the stimulable phosphor sheet.

The radiation image information reading apparatus has a feed system for feeding the stimulable phosphor sheet between the imaging unit and the reading unit. The feed system has roller pairs for feeding the stimulable phosphor sheet while nipping opposite side regions of the stimulable phosphor sheet which serve as non-recording regions.

When the stimulable phosphor sheet is fed while lying in a horizontal plane, the stimulable phosphor sheet tends to be flexed under its own weight. When the stimulable phosphor sheet is flexed, its image recording surface may possibly be brought into contact with the shafts of roller pairs.

Such contact between the stimulable phosphor sheet and the roller shafts may be avoided by increasing the diameters of the rollers of the roller pairs. However, the radiation image information reading apparatus which incorporates the rollers with the increased diameters necessarily becomes larger in size.

SUMMARY OF THE INVENTION

It is a major object of the present invention to provide a sheet feeding apparatus which is arranged to prevent a sheet from contacting shafts of roller pairs and which is also relatively small in size.

The above and other objects, features, and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

A radiation image information reading apparatus which incorporates a sheet feeding apparatus according to the present invention will be described below with reference to the drawings.

Figure 1:
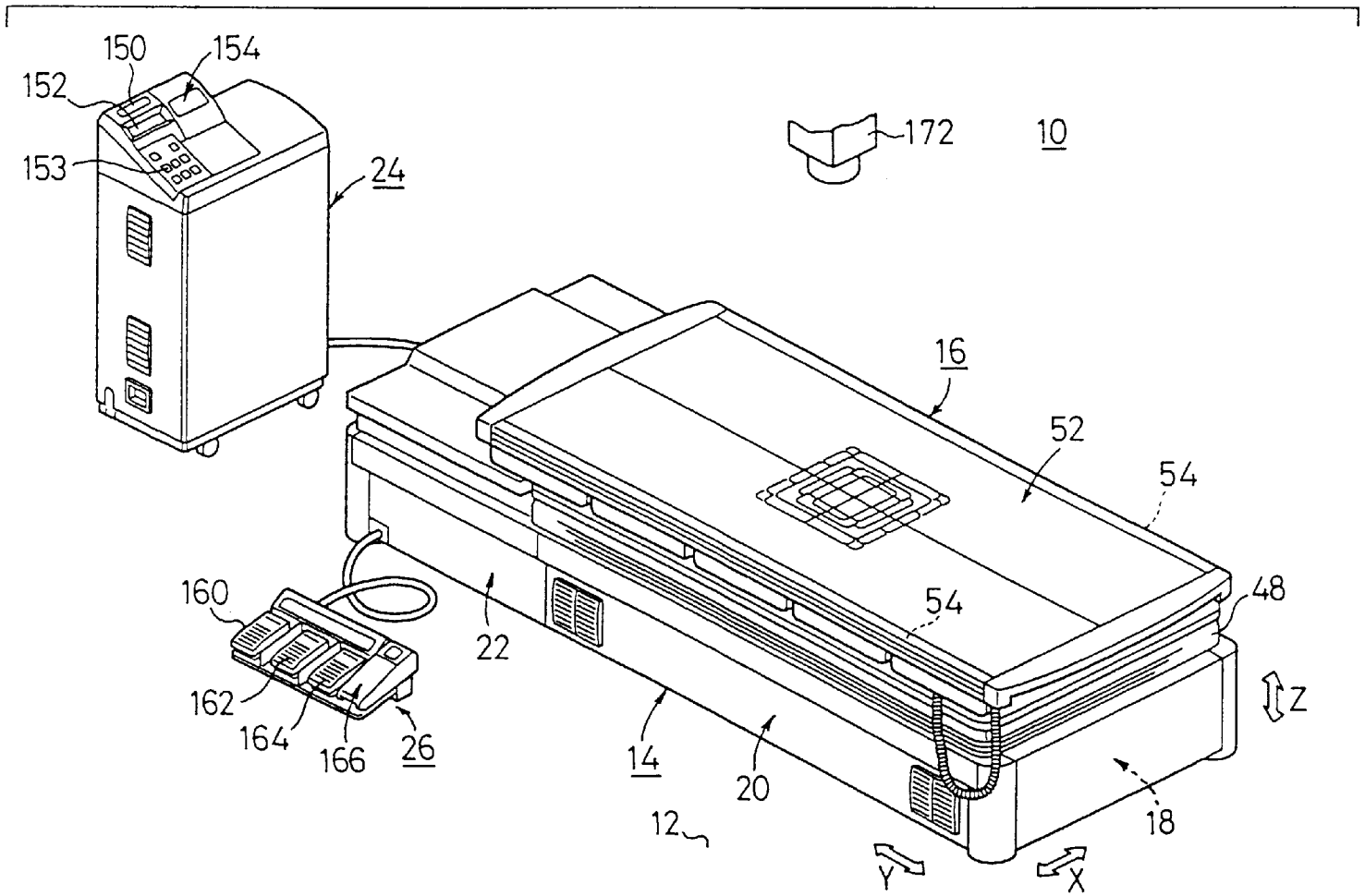
FIG. 1 is a perspective view of a radiation image information reading apparatus which incorporates a sheet feeding apparatus according to the present invention.
Figure 2:
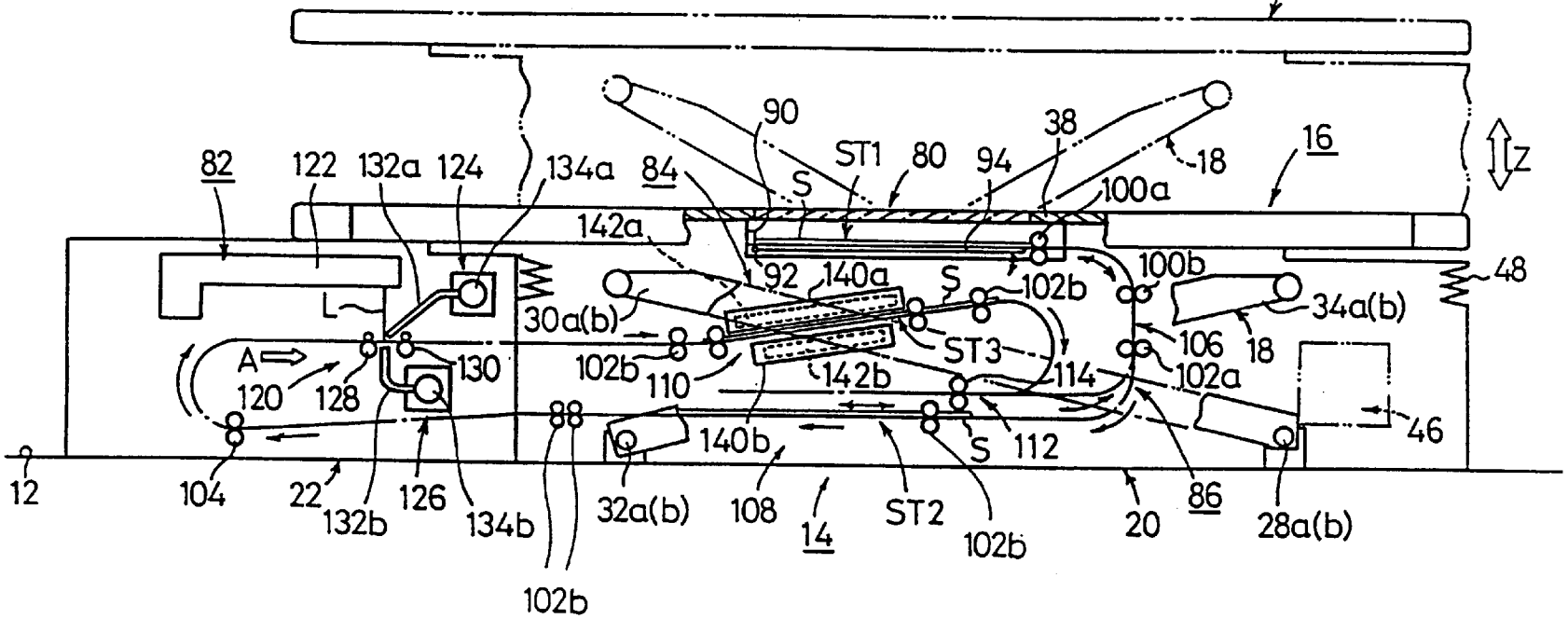
FIG. 2 is a schematic fragmentary side elevational view of an internal structure of the radiation image information reading apparatus.

As shown in FIGS. 1 and 2, a radiation image information reading apparatus 10 comprises a housing 14 placed on a floor or installation surface 12, an imaging bed 16 for supporting a patient, with the back or one side down, directly thereon, and a lifting/lowering mechanism 18 for lifting and lowering the imaging bed 16 with respect to the housing 14. The housing 14 comprises a first casing 20 housing the lifting/lowering mechanism 18 therein and a second casing 22 separate from and adjacent to the first casing 20. A controller 24 and a switch unit 26 are connected to the second casing 22.

Figure 3:
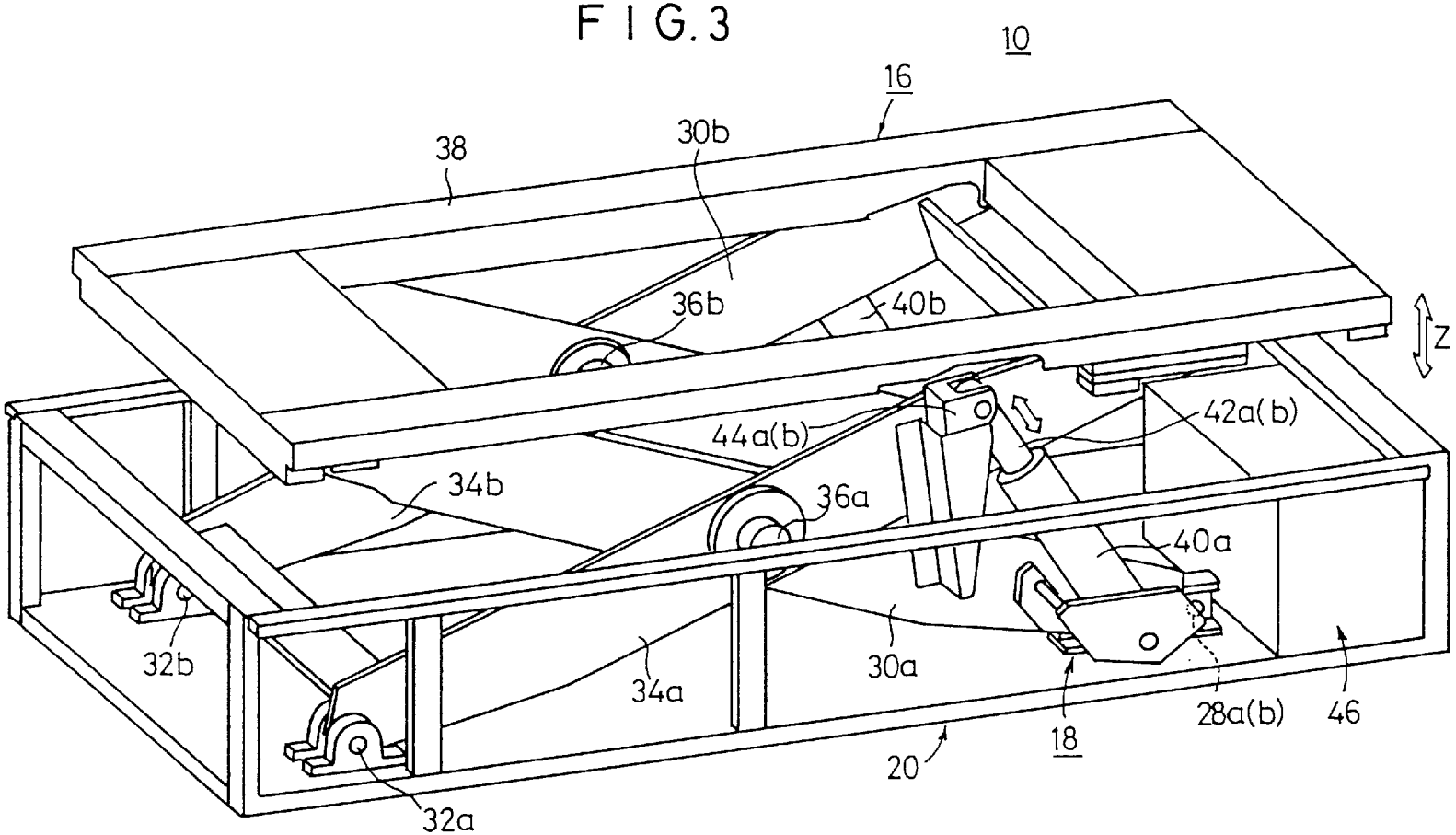
FIG. 3 is a perspective view of an apparatus frame and an imaging bed of the radiation image information reading apparatus.

As shown in FIGS. 2 and 3, the lifting/lowering mechanism 18 comprises a pair of horizontally spaced first swing arms 30*a*, 30*b* swingably supported on one end of the first casing 20 remote from the second casing 22 by respective pivot shafts 28*a*, 28*b*, and a pair of horizontally spaced second swing arms 34*a*, 34*b* swingably supported on the opposite end of the first casing 20 close to the second casing 22 by respective pivot shafts 32*a*, 32*b*. The first and second swing arms 30*a*, 34*a* and the first and second swing arms 30*b*, 34*b* are coupled to each other by respective joint shafts 36*a*, 36*b* at substantially central regions thereof. The first swing arms 30*a*, 30*b* and the second swing arms 34*a*, 34*b* have respective distal ends held in operative engagement with the bottom of a vertically movable base 38 of the imaging bed 16.

Hydraulic cylinders 40*a*, 40*b* are mounted respectively on the first swing arms 30*a*, 30*b* near the pivot shafts 28*a*, 28*b* and have respective rods 42*a*, 42*b* extending toward and coupled to the second swing arms 34*a*, 34*b*, respectively, by attachments 44*a*, 44*b* near upper ends of the second swing arms 34*a*, 34*b*. The hydraulic cylinders 40*a*, 40*b* are controlled by a hydraulic unit 46 mounted in the first casing 14. The hydraulic unit 46 has a pump and valves for controlling the flow of a fluid to and from the hydraulic cylinders 40*a*, 40*b*.

As shown in FIG. 1, a dust-resistant, light-shielding bellows 48 which is vertically expandable and contractible is disposed between and connected to the vertically movable base 38 and the first casing 20. A top table 52 that can be displaced in the transverse directions of the first casing 20 indicated by the arrow X and also in the longitudinal directions indicated by the arrow Y, which are perpendicular to the longitudinal directions indicated by the arrow Y, is mounted on the vertically movable base 38.

Two linear touch switches 54 are fixed to the top panel 52 along the opposite sides thereof. The touch switches 54 are used to turn on and off a lock means, not shown, for locking the top panel 52. While one of the touch switches 54 is being pressed, the lock means unlocks the top panel 52. Covers 56 are mounted on the top panel 52 and positioned outwardly of the touch switches 54.

As shown in FIG. 2, the vertically movable base 38 supports therein a recording unit 80 for temporarily recording radiation image information of a subject on a stimulable phosphor sheet S. The housing 14 houses therein a reading unit 82 for photoelectrically reading the radiation image information recorded on the stimulable phosphor sheet S by applying a laser beam L as exciting light to the stimulable phosphor sheet S, an erasing assembly 84 for erasing remaining radiation image information from the stimulable phosphor sheet S after the recorded image information has been read therefrom, and a circulating feed system (sheet feeding apparatus) 86 for circulating three stimulable phosphor sheets S, for example, in the radiation image information reading apparatus 10.

Figure 4:
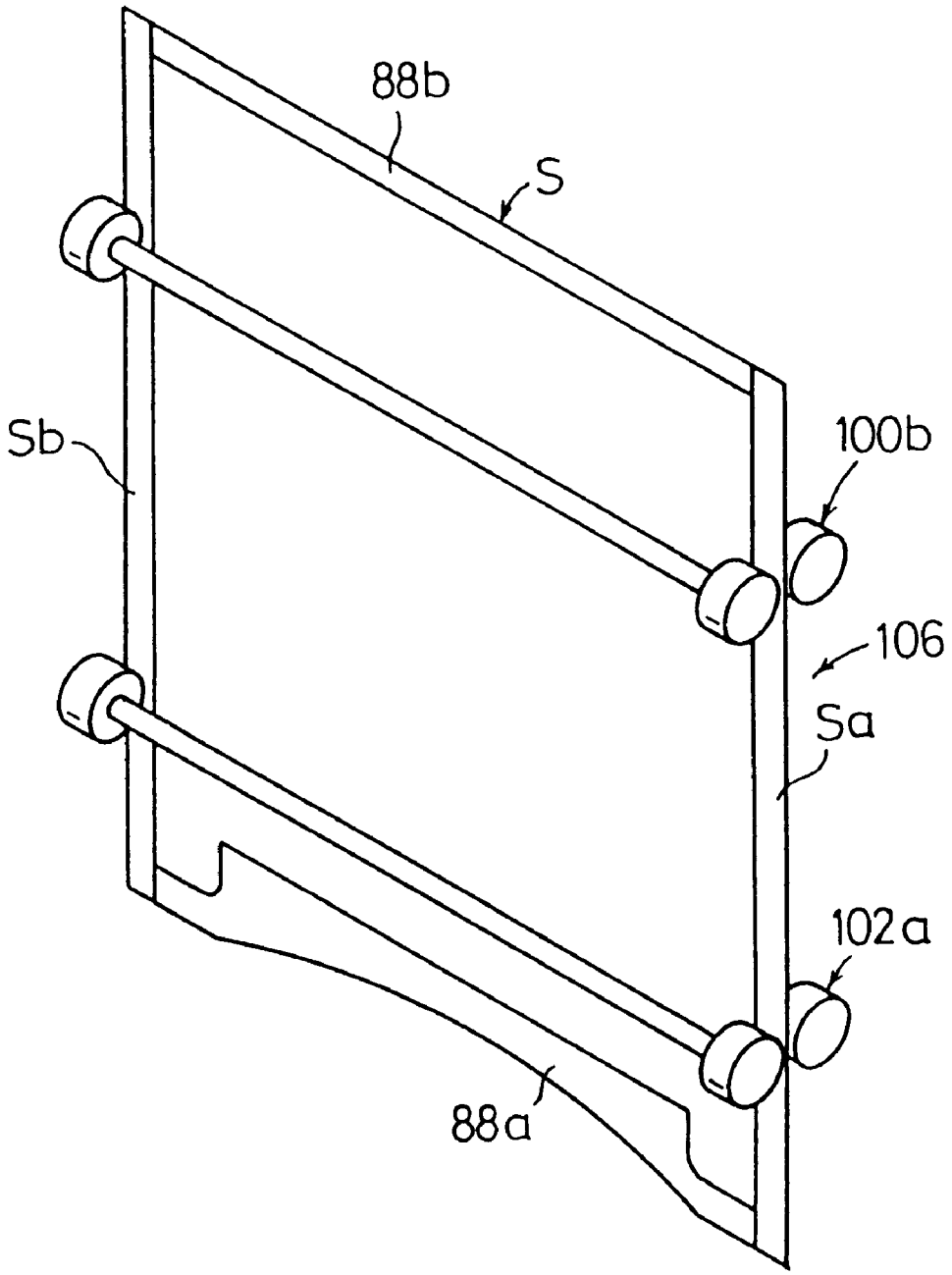
FIG. 4 is a perspective view of a stimulable phosphor sheet.

As shown in FIG. 4, the stimulable phosphor sheet S is gripped only at its opposite marginal edges Sa, Sb when it is fed in circulation. Reinforcing plates 88*a*, 88*b* are fixed to the reverse side of the stimulable phosphor sheet S.

As shown in FIG. 2, the recording unit 80 has a positioning member 90 for positioning the stimulable phosphor sheet S, and a holder plate 94 swingable about a pivot 92 for holding the stimulable phosphor sheet S in position in the recording unit 80. The circulating feed system 86 has a roller pair 100*a* disposed near an inlet/outlet end of the recording unit 80 remote from the positioning member 90, and a roller pair 100*b* spaced a given distance from the roller pair 100*a*. The roller pairs 100*a*, 100*b* are supported on the vertically movable base 38 for vertical movement in unison with the vertically movable base 38.

The circulating feed system 86 also has a plurality of roller pairs 102*a*, 102*b* disposed in the first casing 20. The second casing 22 houses therein a roller pair 104 of another circulating feed system (sheet feeding apparatus) which is independent of the circulating feed system 86. The roller pairs 100*a*, 100*b*, 102*a*, 102*b*, 104 grip only the marginal edges Sa, Sb of the stimulable phosphor sheet S to feed the stimulable phosphor sheet S.

The circulating feed system 86 comprises a vertical feed path 106 extending vertically downwardly from the recording unit 80, a horizontal feed path 108 extending horizontally from the lower end of the vertical feed path 106 to the roller pair 104, an inclined feed path 110 turning 180° back from the roller pair 104 and extending through the reading unit 82 to a position beyond the erasing assembly 84, and a switchback feed path 112 turning 180° back from the tip end of the inclined feed path 110 for sheet switchback and joined to the vertical feed path 106. The circulating feed system 86 includes a reversible roller pair 114 disposed at the switchback feed path 112.

Three stimulable phosphor sheets S are present in the circulating feed system 86 at all times. These stimulable phosphor sheets S can be placed in three standby positions including a first standby position ST1 as a set position in the recording unit 80, a second standby position ST2 disposed in the horizontal feed path 108, and a third standby position ST3 disposed in the erasing assembly 84.

The reading unit 82 is positioned in the second casing 22. The reading unit 82 comprises an auxiliary scanning feed assembly 120 for feeding a stimulable phosphor sheet S in an auxiliary scanning direction which is a horizontal direction indicated by the arrow A, a laser beam radiating device (exciting light radiating means) 122 for applying a laser beam L as exciting light substantially vertically to the stimulable phosphor sheet S as it is fed in the auxiliary scanning direction to scan the stimulable phosphor sheet S in a main scanning direction which is normal to the auxiliary scanning direction, and first and second light collecting systems 124, 126 for photoelectrically reading light that is emitted from the stimulable phosphor sheet S upon application of the laser beam L thereto.

The auxiliary scanning feed assembly 120 has first and second roller pairs 128, 130 that are rotatable in synchronism with each other. The first light collecting system 124 comprises a first light guide 132*a* having an end which is disposed at a position where the laser beam L is applied to a recording surface of the stimulable phosphor sheet S and extends in the main scanning direction, and a first photomultiplier 134*a* mounted on the other end of the first light guide 132*a*. The second light collecting system 126 comprises a second light guide 132*b* having an end which is disposed on the side of the reverse surface of the stimulable phosphor sheet S and extends in the main scanning direction, and a second photomultiplier 134*b* mounted on the other end of the second light guide 132*b*.

The erasing assembly 84 comprises a first erasing unit 140*a* disposed over the recording surface of the stimulable phosphor sheet S and a second erasing unit 140*b* disposed over the reverse surface of the stimulable phosphor sheet S. The first and second erasing units 140*a*, 140*b* have respective erasing light sources 142*a*, 142*b*.

As shown in FIG. 1, the controller 24 has a control panel 154 which has a plurality of lamps 150, a display panel 152, and a plurality of lamps 153 for indicating a recording size with selector keys. When the controller 24 is turned on by the operator who operates a console (not shown) or a recording size is selected, the lamps 150, 153 indicate such turn-on and recording size information, and the display unit 152 displays the ID number and name of a patient registered via the console or a recording menu.

The switch unit 26 has a first foot switch 160 for unlocking the top panel 52 of the imaging bed 16 for horizontal movement thereof, a second foot switch 162 for lowering the imaging bed 16, a third foot switch 164 for lifting the imaging bed 16, and a fourth foot switch 166 for stopping the imaging bed 16 against vertical movement in case of emergency. An X-ray radiating unit 172 is positioned over the top panel 52.

Figure 5:
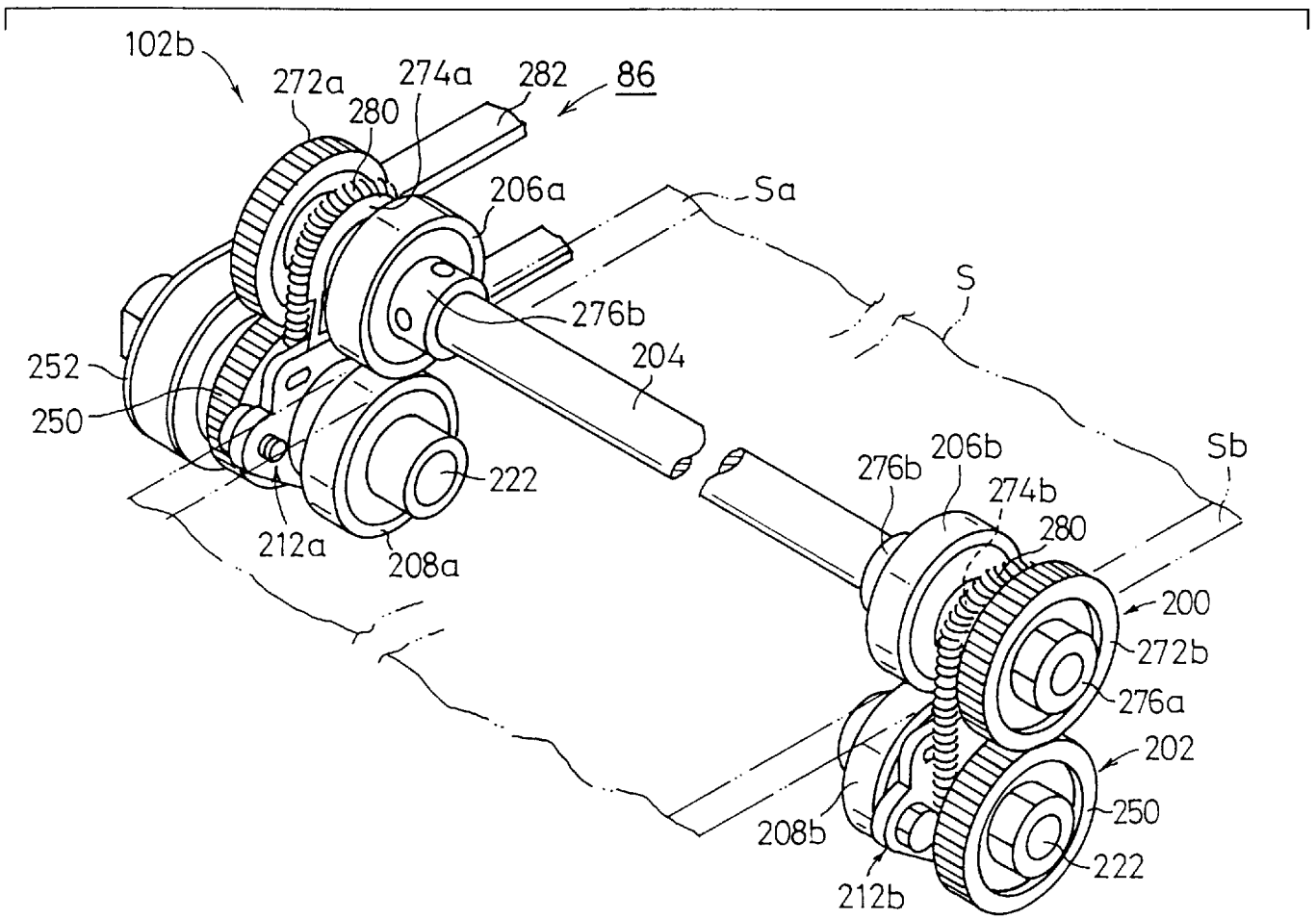
FIG. 5 is a perspective view of a roller pair of a circulatory feed system in the radiation image information reading apparatus.

FIG. 5 shows in perspective a roller pair which may be the roller pair 102*b* of the circulatory feed system 86, the roller pair 104 of the other circulatory feed system, or the like. The roller pair shown in FIG. 5, which will hereinafter be exemplified by the roller pair 102*b*, may be one of the roller pairs other than those positioned in the vertical feed path 106 of the circulatory feed system 86. Specifically, the roller pair shown in FIG. 5 is disposed in such a position that the stimulable phosphor sheet S is fed while lying in an attitude in which it tends to be flexed under its own weight, e.g., in a substantially horizontal attitude.

The roller pair 102*b* has an upper roller 200 disposed in an upper position and a lower roller 202 disposed in a lower position beneath the upper roller 200.

The upper roller 200 has first and second coupled rollers 206*a*, 206*b* interconnected by a shaft 204 for rotation in unison with each other. The lower roller 202 has first and second separate rollers 208*a*, 208*b* paired with the first and second coupled rollers 206*a*, 206*b*, respectively, and being independent of each other.

Figure 6:
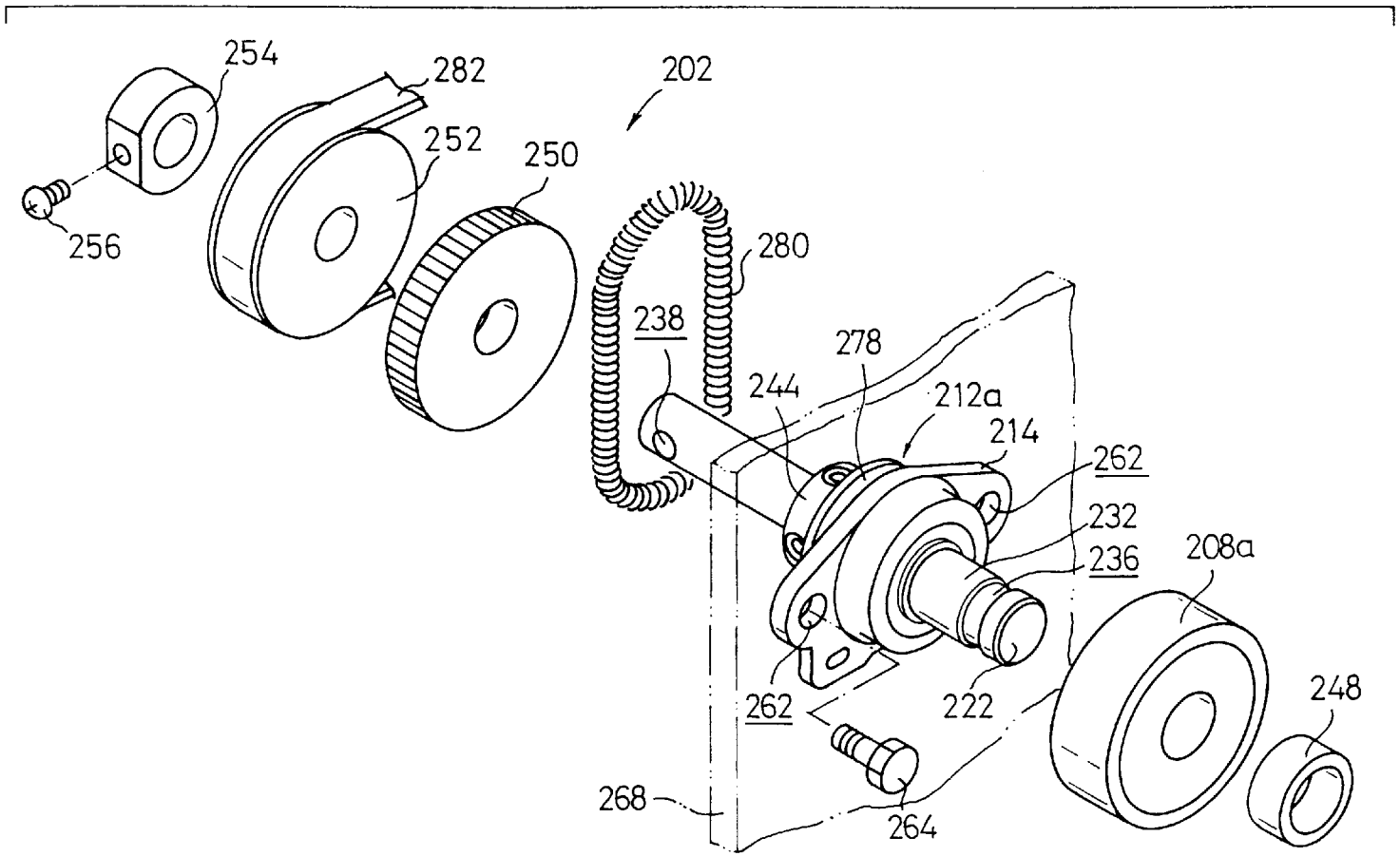
FIG. 6 is an exploded perspective view of a lower roller of the roller pair.

FIG. 6 shows in exploded perspective the first separate roller 208*a* of the lower roller 202. As shown in FIGS. 5 and 6, the lower roller 202 has cantilevered shaft units 212*a*, 212*b* which support the first and second separate rollers 208*a*, 208*b*, respectively.

Figure 7:
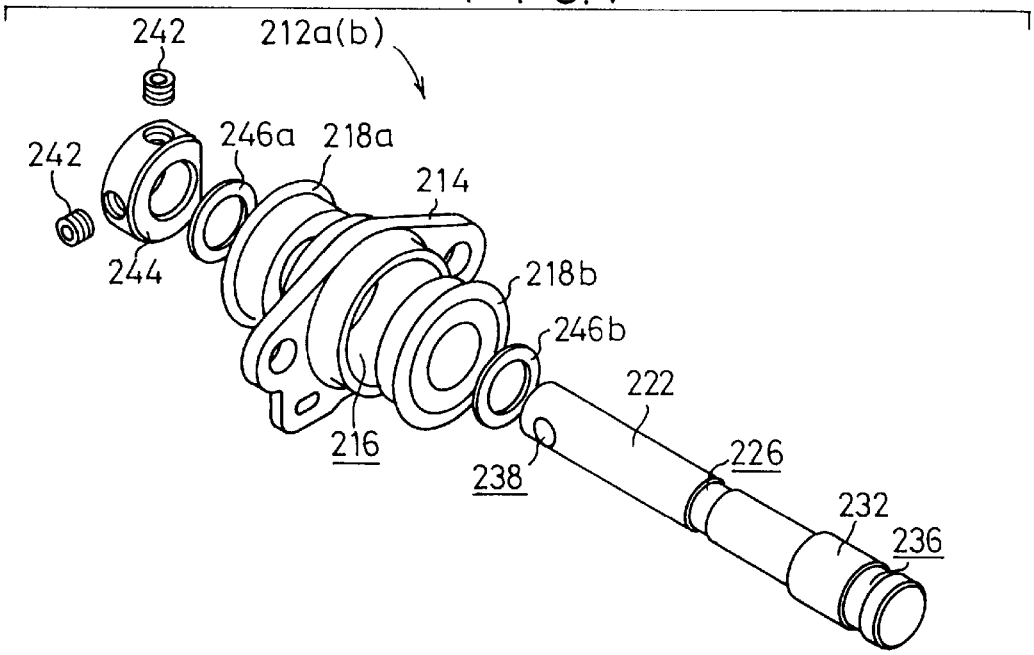
FIG. 7 is an exploded perspective view of a cantilevered shaft unit of the lower roller.

FIG. 7 shows in exploded perspective each of the cantilevered shaft units 212*a*, 212*b*. As shown in FIG. 7, each of the cantilevered shaft units 212*a*, 212*b* comprises a bearing support 214 having a bearing mount hole 216 defined therethrough, a pair of bearings 218*a*, 218*b* mounted coaxially in respective opposite ends of the bearing mount hole 216, and a shaft 222 rotatably supported by the bearings 218*a*, 218*b*.

The shaft 222 has a stopper mount groove 226 defined in a circumferential surface thereof, and a larger-diameter portion 232 disposed on an end portion thereof. The larger-diameter portion 232 has a stopper mount groove 236 defined in an end thereof on the end portion of the shaft 222. The shaft 222 has a stopper attachment hole 238 defined in an opposite end portion thereof.

As shown in FIGS. 6 and 7, the shaft 222 is inserted through the bearings 218*a*, 218*b* mounted in the bearing support 214, and a stopper 244 is mounted in the stopper mount groove 226 by set screws 242. The bearing support 214 and the bearings 218*a*, 218*b* are sandwiched between the stopper 244 and the opposite end of the larger-diameter portion 232.

The shaft 222 is prevented from being axially displaced, and rotatably supported in the bearing support 214 by the bearings 218*a*, 218*b*. Washers 246*a*, 246*b* are interposed between the bearings 218*a*, 218*b* and the stopper 244 and the larger-diameter portion 232 As shown in FIG. 6, the first and second separate rollers 208*a*, 208*b* (only the first separate roller 208*a* shown in FIG. 6) are mounted on respective portions of the larger-diameter portions 232 of the respective shafts 222 which are closer to the centers of the shafts 222 than the stopper mount grooves 236. The first and second separate rollers 208*a*, 208*b* are locked against axial displacement by stoppers 248 that are mounted in the respective stopper mount grooves 236.

A gear 250 such as a spur gear or the like is mounted on the other end of the shaft 222, and a pulley 252 is mounted on the other end of the shaft 222 axially outwardly of the gear 250. A stopper 254 for preventing the gear 250 and the pulley 252 from being dislodged from the shaft 222 is mounted on the other end of the shaft 222 axially outwardly of the pulley 252. The stopper 254 is secured to the shaft 222 by a set screw 256 that is threaded through the stopper 254 into the stopper mount hole 238.

The first and second separate rollers 208*a*, 208*b* and the gears 250 (and the pulley 252 associated with the first separate roller 208*a*) can rotate in unison with the respective shafts 222, respectively.

In FIG. 5, the cantilevered shaft unit 212*b* of the second separate roller 208*b* is shown as being free of the pulley 252. However, the cantilevered shaft units 212*a*, 212*b* may have respective pulleys 252.

As shown in FIG. 6, the bearing support 214 has a plurality of screw attachment holes 262 defined therein, and is fixed to a support panel 268 by screws 264 extending through the respective screw attachment holes 262 threaded over the screws 264.

As shown in FIG. 5, gears 272*a*, 272*b* such as spur gears or the like are mounted respectively on opposite ends of the shaft 204 by which the first and second coupled rollers 206*a*, 206*b* are interconnected. The gears 272*a*, 272*b* are positioned axially outwardly of the respective first and second coupled rollers 206*a*, 206*b*. The gears 272*a*, 272*b* can rotate in unison with the shaft 204 and the first and second separate rollers 208*a*, 208*b*.

Spring holders 274*a*, 274*b* are disposed on the opposite end portions of the shaft 204 axially between the first coupled roller 206*a* and the gear 272*a* and between the second coupled roller 206*b* and the gear 272*b*. The spring holders 274*a*, 274*b* have spring holding grooves, not shown, defined respectively therein. The shaft 204 is rotatable with respect to these spring holders 274*a*, 274*b*.

The first and second coupled rollers 206*a*, 206*b*, the gears 272*a*, 272*b*, and the spring holders 274*a*, 274*b* are prevented from axially displacement by stoppers 276*a*, 276*b* that are mounted on the opposite end portions of the shaft 204 in sandwiching relation to the first and second coupled rollers 206*a*, 206*b*, the gears 272*a*, 272*b*, and the spring holders 274*a*, 274*b*.

As shown in FIG. 6, the bearing supports 214 have respective spring holding grooves 278 defined therein. As shown in FIGS. 5 and 6, springs (resilient members) 280 are trained around the spring holding grooves 278 of the bearing supports 214 and the non-illustrated spring holding grooves of the spring holders 274*a*, 274*b*. As shown in FIG. 5, the first coupled roller 206*a* and the first separate roller 208*a* are normally biased against each other under the resiliency of the corresponding spring 280, and the second coupled roller 206*b* and the second separate roller 208*b* are normally biased against each other under the resiliency of the corresponding spring 280.

Under the resiliency of the springs 280, nipping forces are applied between the first coupled roller 206*a* and the first separate roller 208*a* and between the second coupled roller 206*b* and the second separate roller 208*b* for nipping the marginal edges Sa, Sb of the stimulable phosphor sheet S.

The gears 250 that are positioned closely to the respective first and second separate rollers 208*a*, 208*b* are held in mesh with the gears 272*a*, 272*b*. disposed closely to the first and second coupled rollers 206*a*, 206*b*. Therefore, the first and second separate rollers 208*a*, 208*b* and the first and second coupled rollers 206*a*, 206*b* are rotatable in synchronism with each other.

Specifically, when rotational power from an actuating device, not shown, is applied to the pulley 252 by a transmitting means such as a timing belt 282, the pulley 252 is rotated to rotate the first and second separate rollers 208*a*, 208*b* and the first and second coupled rollers 206*a*, 206*b*.

The stimulable phosphor sheet S is fed by and nipped between the first and second separate rollers 208*a*, 208*b* and the first and second coupled rollers 206*a*, 206*b*.

Figure 8:
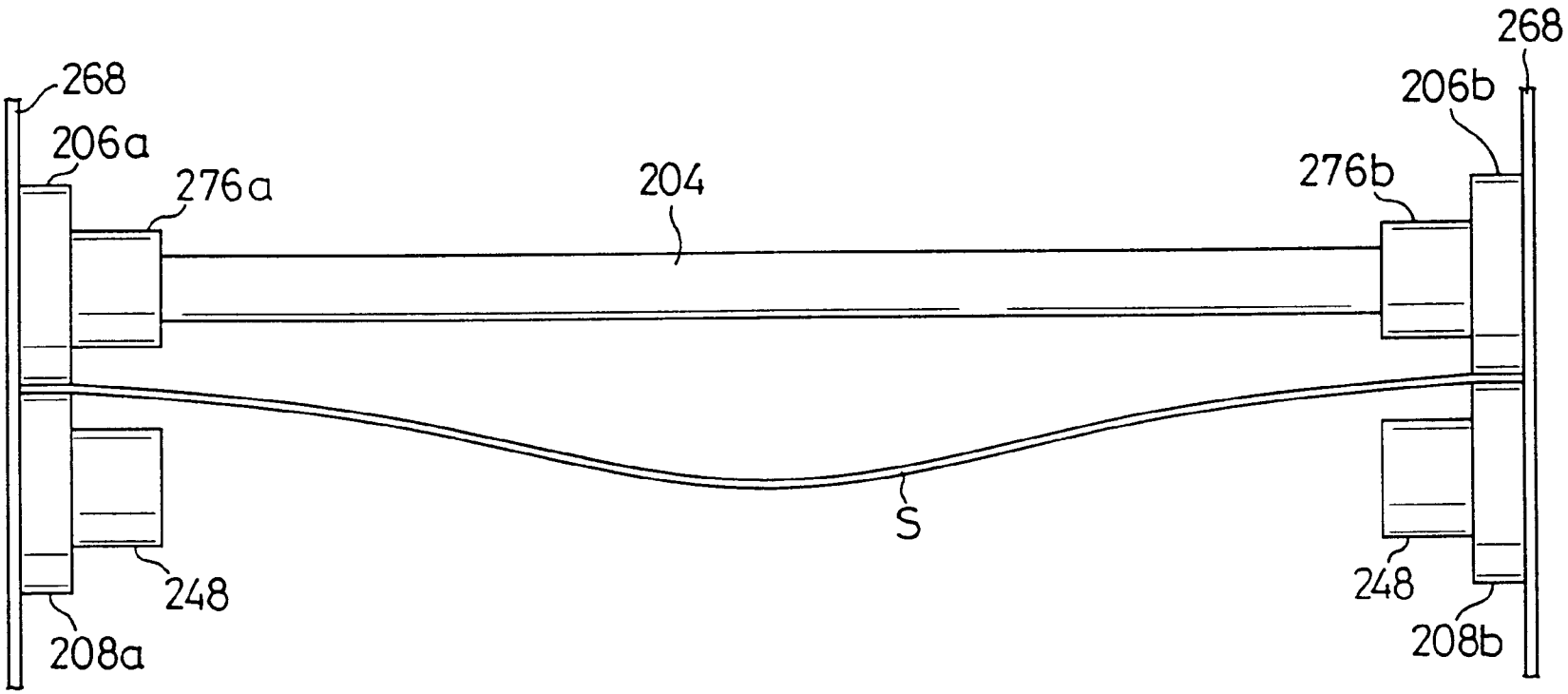
FIG. 8 is a front elevational view showing the manner in which the stimulable phosphor sheet is flexed when it is fed by the roller pair.

At this time, as shown in FIG. 8, even when the stimulable phosphor sheet S is flexed under its own weight, since no shaft is present between the first and second separate rollers 208*a*, 208*b* to which the stimulable phosphor sheet S is flexed, the convexly flexed surface of the stimulable phosphor sheet S, i.e., the image recording surface thereof, does not contact the lower roller 202.

Operation of the radiation image information reading apparatus 10 will be described below.

An ID card carrying ID information of a patient, including an ID number and a name, is prepared and read by the console. The console selects an imaging area, such as a chest or an abdomen, of the patient, and a recording menu. Then, a recording size is selected, if necessary. Then, the patient as a subject to be imaged is placed on the imaging bed 16.

At this time, the vertical position of the imaging bed 16 in the direction indicated by arrow Z is adjusted depending on the condition of the patient, the height of the patient, and the carriage, such as a wheelchair, a stretcher, or the like, by which the patient has been carried. Specifically, the operator presses the second foot switch 162 to cause the hydraulic unit 46 of the lifting/lowering mechanism 18 to operate the hydraulic cylinders 40*a*, 40*b* (see FIG. 3). The rods 42*a*, 42*b* of the hydraulic cylinders 40*a*, 40*b* are retracted to swing the second swing arms 34*a*, 34*b*, which are coupled to the rods 42*a*, 42*b* by the attachment 44*a*, 44*b*, downwardly about the pivot shafts 32*a*, 32*b*.

Since the first swing arms 30*a*, 30*b* are coupled to the second swing arms 34*a*, 34*b* by the joint shafts 36*a*, 36*b*, when the second swing arms 34*a*, 34*b* are turned downwardly, the first swing arms 30*a*, 30*b* are angularly moved downwardly about the pivot shafts 28*a*, 28*b*. Therefore, the vertically movable base 38 is moved downwardly to lower the imaging bed 16.

When the operator presses the third foot switch 164, the hydraulic unit 46 actuates the hydraulic cylinders 40*a*, 40*b* in the opposite direction. Therefore, the vertically movable base 38 supported by the first swing arms 30*a*, 30*b*and the second swing arms 34*a*, 34*b* is elevated, thus lifting the imaging bed 16.

In this manner, the imaging bed 16 is adjusted to a vertical position where the patient can easily be placed onto the top panel 52. After the patient is placed on the top panel 52 with the back or one side down, the operator selectively presses the second foot switch 162 or the third foot switch 164 to adjust the vertical position of the top panel 52 for easy subsequent imaging operation. The operator further presses the first foot switch 160 or continuously turns on one of the touch switches 54 on the top panel 52 to unlock the top panel 52.

With the touch switch 54 being continuously pressed, the operator slides the top panel 52 in the directions indicated by the arrows X, Y to adjust the position of the patient until the imaging area of the patient enters a radiating range of the X-ray radiating unit 172. After the imaging area of the patient is positioned, the operator releases the touch switch 54 to lock the top panel 52.

The X-ray radiating unit 172 is then energized to record radiation image information of the patient on a stimulable phosphor sheet S in the recording unit 80. At this time, the other two stimulable phosphor sheets S are placed in the second and third standby positions ST2, ST3, respectively.

When the roller pair 100*a* of the circulating feed system 86 is rotated, the stimulable phosphor sheet S which has recorded the radiation image information is gripped at its marginal edges Sa, Sb by the roller pair 100*a* and removed from the recording unit 80. The stimulable phosphor sheet S is then gripped by the roller pairs 100*b*, 102*a* and transferred from the vertical feed path 106 into the horizontal feed path 108 (see FIG. 4). Then, the stimulable phosphor sheet S is fed from the first casing 20 into the second casing 22 by the roller pairs 102*a*, 102*b*, and turned 180° above the horizontal feed path 108 by the roller pair 104 and fed into the auxiliary scanning feed assembly 120 of the reading unit 82.

In the auxiliary scanning feed assembly 120, the first and second roller pairs 128, 130 are synchronously rotated by a motor (not shown). The stimulable phosphor sheet S is gripped at its marginal edges Sa, Sb by the first and second roller pairs 128, 130 and fed in the auxiliary scanning direction indicated by the arrow A. At this time, the laser beam L is emitted from the laser beam radiating device 122 and applied to the recording surface of the stimulable phosphor sheet S to scan the stimulable phosphor sheet S in the main scanning direction.

When irradiated by the laser beam L, the recording surface of the stimulable phosphor sheet S emits light which represents the recorded radiation image information. The emitted light is photoelectrically read by the first light collecting system 124. Light that has passed through a transparent base of the stimulable phosphor sheet S is emitted from the reverse surface thereof, and photoelectrically read by the second light collecting system 126.

The stimulable phosphor sheet S, from which the recorded radiation image information has been read, is fed from the second casing 22 back into the first casing 20, and delivered along the inclined feed path 110 into the erasing assembly 84. In the erasing assembly 84, the erasing light sources 142*a*, 142*b* of the first and second erasing units 140*a*, 140*b* apply erasing light to the both surfaces of the stimulable phosphor sheet S to erase unwanted remaining radiation image information from the stimulable phosphor sheet S.

After the remaining radiation image information has been erased from the stimulable phosphor sheet S, the stimulable phosphor sheet S is turned 180° below the inclined feed path 110 and delivered into the switchback feed path 112. The roller pair 114 on the switchback feed path 112 is reversed to feed the stimulable phosphor sheet S from the switchback feed path 112 into the vertical feed path 106, along which the stimulable phosphor sheet S is delivered by the roller pairs 100*a*, 100*b* into the recording unit 80.

In the radiation image information reading apparatus 10 according to the first embodiment of the present invention, the lower roller 202 of, typically, the roller pair 102*b* of the circulatory feed system 86 has no shaft between the first and second separate rollers 208*a*, 208*b*. Therefore, even when the stimulable phosphor sheet S fed by the roller pair 102*b* and other similar roller pairs is flexed under its own weight, the convexly flexed surface of the stimulable phosphor sheet S does not contact the lower roller 202 (see FIG. 8). Consequently, the image recording surface of the stimulable phosphor sheet S is reliably prevented from contacting the roller pair 102*b*.

Since the diameters of the first and second coupled rollers 206*a*, 206*b* and the first and second separate rollers 208*a*, 208*b* are not required to be large in order to prevent contact with the image recording surface of the stimulable phosphor sheet S, the roller pair 102*b* and other similar roller pairs may be relatively small in size.

Figure 9:
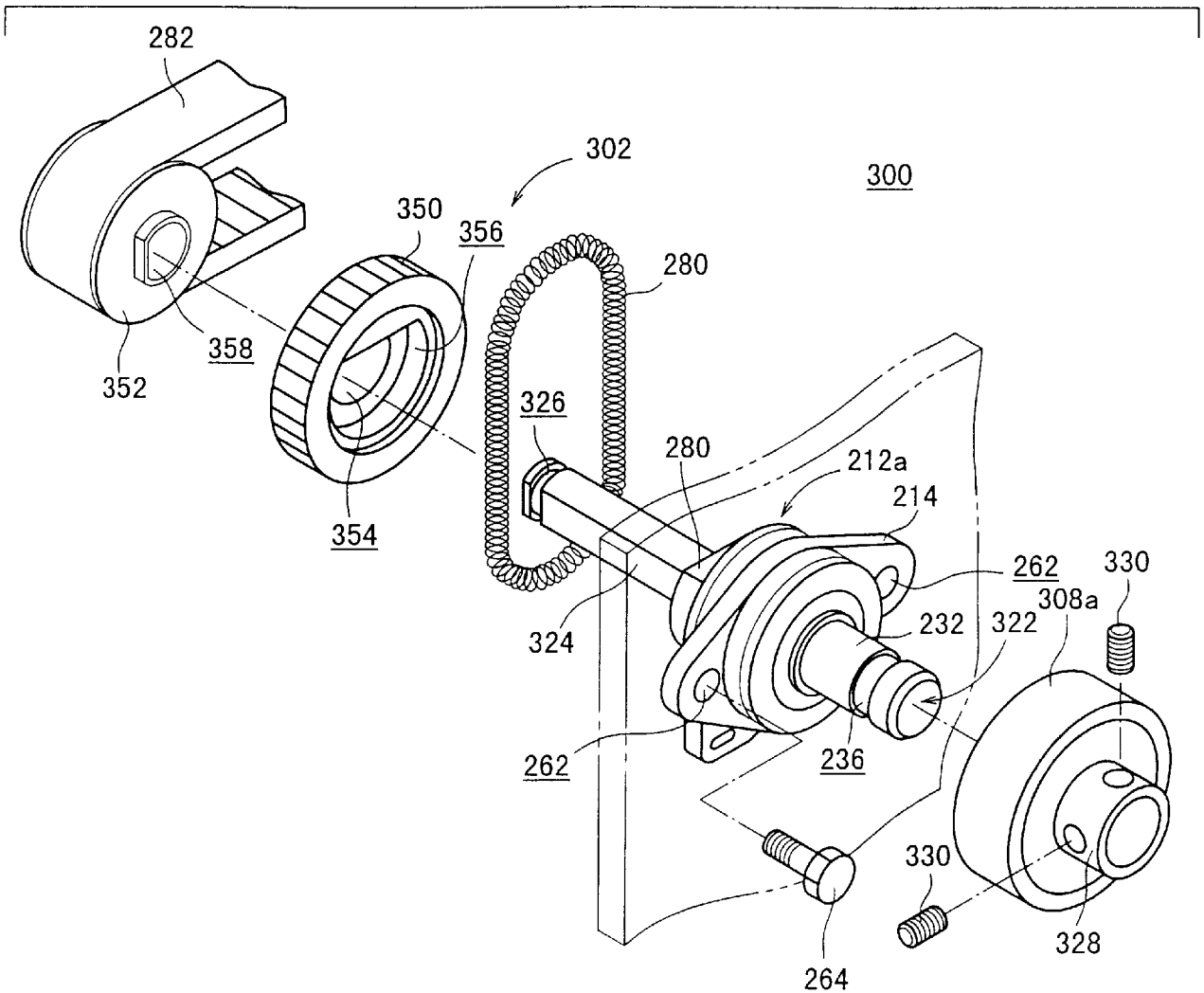
FIG. 9 is an exploded perspective view showing a side of a first separate roller (a lower roller) of a circulatory feed system according to a second embodiment of the present invention.
Figure 10:
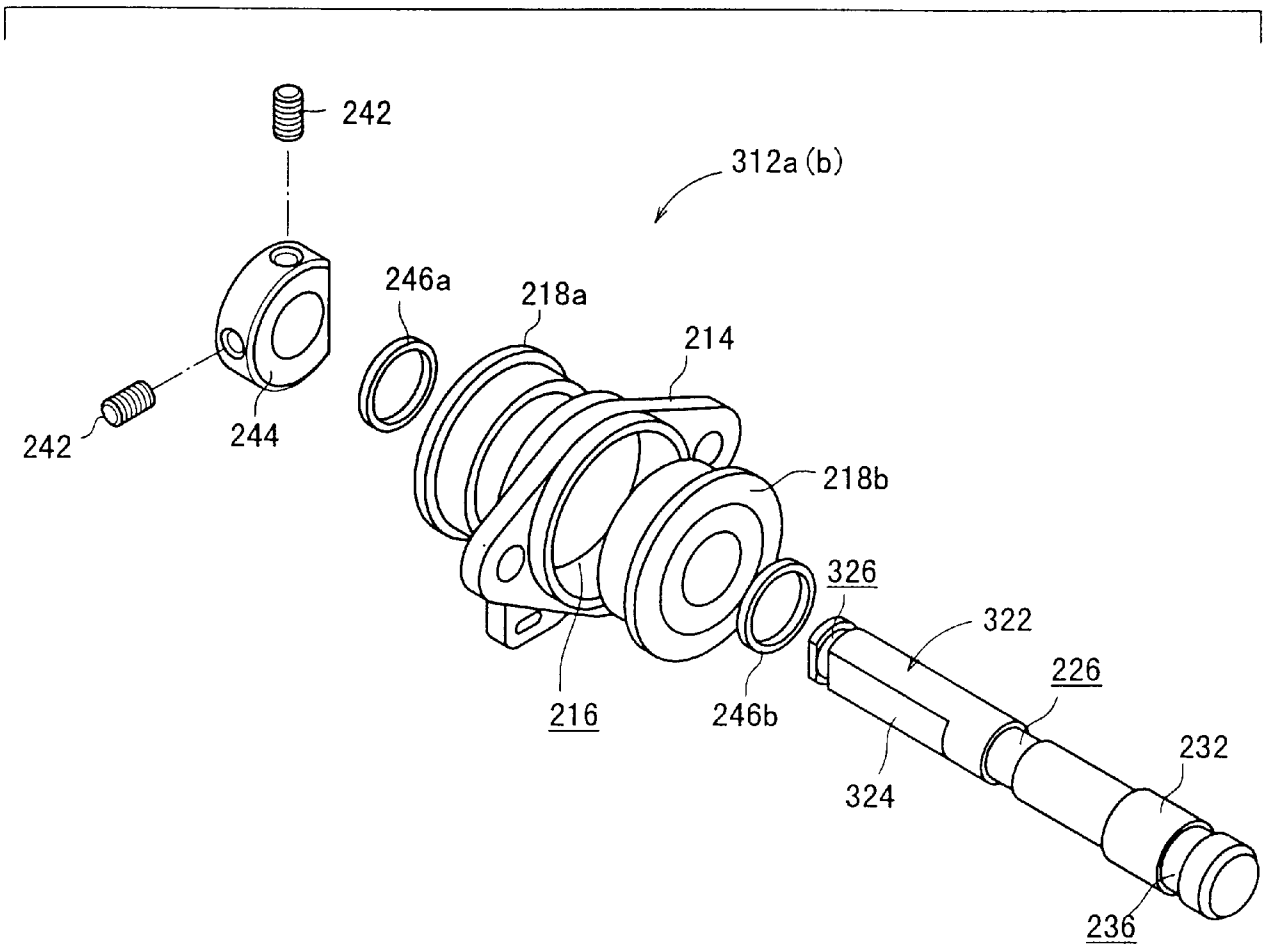
FIG. 10 is an exploded perspective view of a cantileverd shaft unit.

FIG. 9 is an exploded perspective view showing a side of a first separate roller, i.e., a lower roller 308*a* of a circulatory feed system 300 (sheet feeding apparatus) according to a second embodiment of the present invention, and FIG. 10 is an exploded perspective view of a cantileverd shaft unit. In FIGS. 9 and 10, elements similar to those of the circulatory feed system according to the second embodiment are denoted by the same reference numerals and the detailed description thereof will be omitted.

A shaft 322 of the cantilevered shaft unit 312*a* (312*b*) has stopper mount grooves 226 and 326. Further, the shaft 322 has a flat surface 324 extending from an end of the shaft 322 where the stopper mount groove 326 is defined to a point close to the stopper mount groove 226. A cylindrical portion 328 functioning as a stopper is formed on the first separate roller 308*a* integrally. Set screws 330 screwed in to the cylindrical portion 328 are held in engagement with the stopper mount groove 326 of the shaft 322 for fixing the first separate roller 308*a* to the shaft 322.

A gear 350 mounted on the shaft 322 has a hole 354 and a concave 356 defined therein. The shaft 322 is inserted through the hole 354 into the central region of the gear 350 and the stopper 244 is fitted into the gear 350 at the concave 356. The concave 356 is defined in a substantially D-shape corresponding to the shape of the stopper 244. By mounting the gear 350 on the stopper 244, it is possible to prevent the rotation of gear 350 with respect to the shaft 244. A pulley 352 has a hole 358 in a substantially D-shape for allowing the shaft 322 to be fitted into the hole 358. Thus, it is possible to also prevent the rotation of the pulley 352 with respect to the shaft 322. After the gear 350 and the pulley 352 are mounted on the flat surface 324 of the shaft 322, a snapping ring (not shown) is attached to the stopper mount groove 326.

The second embodiment described above is advantageous in that it is possible to achieve the same effect as that of the first embodiment. In addition, according to the second embodiment, the number of components needed for producing a sheet feeding apparatus can be reduced effectively and the production line thereof can be simplified. Thus, it is possible to produce a sheet feeding apparatus at a reduced cost.

The built-in radiation image information reading apparatus 10 with stimulable phosphor sheets S being circulated in the apparatus housing 14 has been described in the above first and second embodiments. However, the principles of the present invention are also applicable to a radiation image information reading apparatus of the type where a stimulable phosphor sheet S is loaded via a cassette or a magazine.

Each of the roller pairs of the sheet feeding apparatus has first and second coupled rollers that are interconnected by a shaft and first and second separate rollers that are independent of each other. Inasmuch as no shaft is present between the first and second separate rollers, even when a sheet fed by the roller pair is flexed, the image recording surface of the sheet is prevented from contacting any shaft which would otherwise present between the first and second separate rollers of the roller pair. Furthermore, because the diameters of the first and second coupled rollers and the first and second separate rollers are not required to be large, the roller pair may be relatively small in size.

Although a certain preferred embodiment of the present invention has been shown and described in detail, it should be understood that various changes and modifications may be made therein without departing from the scope of the appended claims.

What is claimed is:

1. An apparatus for feeding a sheet, comprising:

a roller pair for feeding the sheet while nipping marginal side edges of the sheet;

said roller pair comprising:

a first coupled roller and a second coupled roller interconnected by a shaft; and a first separate roller and a second separate roller, said first separate roller paired with said first coupled roller and said second separate roller paired with said second coupled roller, said first and second separate rollers not being directly interconnected by a shaft, and said first and second separate rollers being positioned in a region toward which said sheet is flexed.

2. An apparatus according to claim 1, wherein said roller pair comprises resilient members operatively connecting said first coupled roller and said first separate roller to each other and operatively connecting said second coupled roller and said second separate roller to each other, for applying nipping forces between said first coupled roller and said first separate roller and between said second coupled roller and said second separate roller.

3. An apparatus according to claim 1, wherein said first and second separate rollers are disposed below said first and second coupled rollers.

4. An apparatus according to claim 3, wherein said roller pair comprises resilient members operatively connecting said first coupled roller and said first separate roller to each other and operatively connecting said second coupled roller and said second separate roller to each other, for applying nipping forces between said first coupled roller and said first separate roller and between said second coupled roller and said second separate roller.

5. An apparatus according to claim 1, further comprising:

support members, said first and second separate rollers being supported on said support members, respectively; and transmitting means operatively coupled to at least one of said first and second separate rollers, for transmitting drive power from an actuating device.

6. An apparatus according to claim 1, further comprising:

gears operatively connecting said first coupled roller and said first separate roller to each other and operatively connecting said second coupled roller and said second separate roller to each other.

7. An apparatus according to claim 6, further comprising:

shafts rotatably supported on bearing supports by respective bearings, said gears being mounted on said shafts, respectively;

said shafts having larger-diameter portions with said first and second separate rollers mounted on end portions thereof; and stoppers mounted on respective ends of said larger-diameter portions for holding said first and second separate rollers against axial movement.

8. An apparatus according to claim 1, wherein said roller pair is operative to feed a stimulable phosphor sheet for recording radiation image information thereon.

* * * * *